United States Patent [19]

Malone

[11] Patent Number: 4,741,245

[45] Date of Patent: May 3, 1988

[54] METHOD AND APPARATUS FOR AIMING ARTILLERY WITH GPS NAVSTAR

[75] Inventor: Daniel K. Malone, Purcellville, Va.

[73] Assignee: DKM Enterprises, Purcellville, Va.

[21] Appl. No.: 915,990

[22] Filed: Oct. 3, 1986

[51] Int. Cl.[4] ..... F41G 3/16

[52] U.S. Cl. ..... 89/41.03; 89/41.19; 342/357

[58] Field of Search ..... 89/41.03, 41.19; 342/352, 356, 357, 457; 364/423

[56] References Cited

U.S. PATENT DOCUMENTS

| | | | |
|---|---|---|---|
| 4,232,313 | 11/1980 | Fleishman | 342/456 |
| 4,384,293 | 5/1983 | Deem et al. | 342/352 |
| 4,409,468 | 10/1983 | Mayer et al. | 364/423 |

*Primary Examiner*—Stephen C. Bentley
*Attorney, Agent, or Firm*—Bacon & Thomas

[57] ABSTRACT

A method and apparatus for aiming artillery by incorporating the GPS NAVSTAR system directly into a mobile artillery unit such as a howitzer. A firts GPS ground station is incorporated into a howitzer. A second GPS ground station is located at a distance from the first station. A Receiver Processor Unit at the first GPS ground station receives the position of both first and second ground stations, as well as any other GPS ground stations that are in range, and determines an external reference direction and a reference angle for the second GPS station with respect to the reference direction. An azimuth transfer mechanism is aligned with the second GPS station at the reference angle so that the howitzer shares a common alignment with all guns in an artillery battery and the entire artillery battery may be aimed at a single target. Preferably the second GPS station also comprises a howitzer so that the artillery battery disperses in tactically preferred groups of two howitzers each.

29 Claims, 2 Drawing Sheets

METHOD AND APPARATUS FOR AIMING ARTILLERY WITH GPS NAVSTAR

BACKGROUND OF THE INVENTION

1. Field of the Invention

The present invention relates to directing artillery fire.

2. Description of Related Art

During the first World War, most Western armies fully adopted a concept known as "indirect" fire. This technique involved deploying artillery in batteries positioned behind friendly lines under cover of hills, woods, and any other obstruction that hid the battery. A survey network connected the artillery battery in a network with forward observers and fire direction centers. Survey traverses were run to each battery in a "common grid" so that all guns in range could fire at a common target by measuring an azimuthal angle from north and adjusting the elevation of the gun barrel for the altitude and cant of the gun at its particular position.

The process of pointing a piece of artillery involved a crew setting out aiming stakes which the gunner used as a point of reference. The aiming stakes were viewed through a panoramic sight and, with the aid of an aiming instrument such as a mil scale, the angle to the target was measured off of the line determined by the aiming stakes. The entire artillery battery was aligned by setting an aiming circle over a known point which had been surveyed by the survey parties. Angular measurements were taken to each piece of artillery so that each gun could be aligned with each other with reference to a common direction line such as north. The positioning of the guns was then correlated to the coordinates of the target as derived from a map or observers.

A new historical phase began with the introduction of rapid and accurate counterbattery weaponry. Counterbattery weapons destroy artillery by identifying the artillery shells in flight with radar, determining their point of origin and returning fire or by other detection means locate the source of fire and begin counterbattery engagements. Semi-permanent "firebases" thus are not practical against modern counter battery measures. Rather, the presence of counterbattery weapons on a battlefield forces the artillery battery to "shoot-and-scoot"; in other words, the artillery battery must fire many rounds in a short period of time and then move before the counterbattery weapons of the enemy return fire. Furthermore, the artillery battery must quickly resume firing at a new location to deliver enough ordnance to be effective. For example, in any combat with the forces of the Warsaw Pact, NATO anticipates having to stop large numbers of highly concentrated, rapidly attacking armored vehicles protected by counterbattery weapons. NATO forces must be able to move quickly and shoot fast.

Despite the introduction of counterbattery weaponry, the techniques used to direct artillery fire remain essentially unchanged from the First World War. As a result, current methods of redeploying field artillery lag behind the tactical requirements imposed by counterbattery weapons. The artillery forces of NATO are at risk of either being ineffective or totally destroyed early in any combat with forces of the Warsaw Pact.

Various technological solutions have been proposed for making the artillery more nimble and maneuverable. One approach consists of an autonomous gun positioning system (AGPS) which supplies each individual gun with its position as well as a common reference direction. A present example of this type of positioning system is based on a ring laser gyro. A laser gyro senses changes in three dimensional position and continuously recomputes the direction of north, gun azimuth, and some AGPS even determine the cant of the gun. However, artillerists generally prefer positioning the laser gyro on the trunnions of the howitzer where the gunner normally determines the azimuth and elevation angles. The trunnions also absorb the recoil shock of a howitzer when it is fired. It is difficult to make a laser ring gyro that can withstand the repeated shock of a howitzer firing. In any event, laser ring gyros are basically quite expensive and delicate.

Other AGPS systems use an inertial gyro to sense spacial displacement. The inertial gyro is initially oriented with separate, independent means such as a north finding instrument. Other AGPS are "coupled" to an axle of the artillery piece so as to measure how far the gun moves. The accuracy of an inertial gyro system is limited, however, because of inherent inaccuracies in the inertial gyro as well as by errors introduced by slippage of the wheel caused by, for example, traveling over snow, mud, or sand. The limited accuracy of this type of system forces the battery to periodically disengage from combat and realign its inertial gyros. Disengaging from battle is clearly undesirable.

Another gun positioning system is the Position Location and Reporting System (PLRS) which uses a network of terrestrially based radio transmitters having a known position to locate additional stations at unknown locations. This type of system is similar to the LORAN or SHORAN systems currently used to determine the location of ships and planes. A PLRS system inevitably suffers from any number of vagaries associated with terrestrial emissions of electromagnetic radiation that compromise accuracy. Further, the electromagnetic emissions from these systems make the transmitters easy to locate and destroy.

Yet another class of positioning system is the Position and Azimuth Determining System (PADS) adopted by the armies of several nations including those of the United States and United Kingdom. PADS are similar to inertial coupled systems. Howitzers are mounted on tracks so as to bash through almost anything. PADS, however, can't cope with the shocks experienced by howitzers driving over rough terrain. Hence, PADS are normally mounted on separate survey vehicles where they receive fewer shocks since a driver can choose the best route for surveying rather than the best route for driving a howitzer to its assigned position. Like inertial systems, however, PADS also require periodic realignment and have limited accuracy. The first steps in aligning PADS are unevolved from common survey methods. And even with PADS the final steps involved in triangulating the position of each artillery unit in the battery are essentially the same as first used in the First World War: a crew member must leave the relative safety of the howitzer and enter a potentially contaminated environment to set out the aiming stakes. Moreover, each PAD may cost as much as quarter million dollars each which make PADS uneconomical to integrate into a combat vehicle.

A revolutionary new system for surveying and navigating uses the satellite system commonly known as the GeoPositioning System or GPS NAVSTAR. Eventually a constellation of at least eighteen satellites should transmit ephemeral data to enable GPS receivers on ships, planes, land vehicles or infantrymen to quickly and accurately determine to within meters their exact terrestrial position in three dimensions. The physical size and cost of GPS receivers is decreasing rapidly with the introduction of advanced 5 microchips and microprocessors.

The GPS system enables individual howitzers to ascertain their terrestrial position with simple, low cost equipment that will become substantially less complex and less expensive. In contrast, making inertial systems and PADS more accurate will also make them more complex and expensive. It is not surprising, therefore, that several concepts have been advanced for using GPS to direct artillery fire. Many proposals, however, involve only substituting a GPS station for a traditional triangulation station. The current solutions for finding north and surveying individual howitzer batteries include steps that are essentially unchanged from methods introduced in the First World War.

Some proposals have been made to take two sequential position fixes with one GPS ground receiver and then determine the azimuthal angle between the two measurements as is currently done with the PADS system. For tactical reasons, however, a howitzer is not always able to stop and measure its location. Moving the howitzer to a second position just to get a reading, or stopping to take a reading while approaching the firing position, slows the process of quickly occupying a position and opening fire. Further, a two step firing procedure may be tactically untenable.

Another proposal is to deploy two GPS antenna units along the barrel of the howitzer. The barrel of the howitzer provides the base line for determining north. This base line, however, is inconveniently short with present technology to determine direction to a sufficient accuracy. A "one gun" solution does not make use of tactical practice of dispersing artillery in units of at least two guns and requires an separate, independent backup system for the case where a GPS receiver, or the entire GPS system, fails.

The GPS satellites provide data in one of two coded forms: a very accurate P Code which is classified and limited to the US and selected Allies, and the CA code available for all civilian applications. If the CA code is used to accomplish artillery fire control, the ground stations must accommodate "differential techniques" using known locations and special mathematics known to those skilled in the art.

No known system for aiming artillery that uses GPS accommodates all these factors with tactical practicality.

SUMMARY OF THE INVENTION

The present invention relates to a method and apparatus for aiming artillery by incorporating the GPS NAVSTAR system directly into a mobile artillery unit such as a self-propelled or towed howitzer. A first GPS ground station is incorporated into a howitzer. A second GPS ground station is located at a distance from the first station. A Receiver Processor Unit (RPU) at the first GPS ground station receives the position of both first and second ground stations, as well as any other GPS ground stations that are in range. The RPU determines an external reference direction and a reference angle to each remote GPS station with respect to the reference direction. An azimuth transfer mechanism is aligned with the second GPS station at its reference angle so that the howitzer shares a common coordinate alignment with all the guns in an artillery battery so that the entire artillery battery may be aimed at a single target.

The present invention improves the survivability and reliability of a howitzer in at least three ways. First, survivability is improved by eliminating any need for a soldier to dismount to set out aiming stakes in a contaminated environment. Second, the present invention requires adding to a howitzer only a few additional elements of aiming hardware. The hardware that is added, a modified mil scale, GPS receiver and positioning computer, comprise relatively simple and reliable components that do not require much periodic maintenance or realignment on the battlefield. Finally, the aiming apparatus of the present invention provides its own back up system since the modified mil scale is fully compatible with other aiming techniques. The back up system using the mil scale is always immediately available if a GPS receiver, or the entire GPS system, fails.

Most western artilleries have experimented with dispersal tactics to protect against counterbattery fire. These artilleries have decided to disperse in sections containing at least two guns each for reasons of combat cohesion and tactical control. Therefore, it is tactically preferable that second GPS station also comprises a howitzer so that the artillery battery may disperse in groups of two howitzers each. Additional GPS may be deployed to further increase the accuracy of the alignment process.

While disclosed in connection with a howitzer, the principles of the present invention may be used to align other ballistic trajectory weapons or air defense missile batteries, e.g. HAWK or PATRIOT, or Remotely Piloted Vehicle (RPV) systems. The same apparatus disclosed herein might be used to align any of these systems. Alternately, the apparatus may be adapted to the special requirements of the particular system.

DETAILED DESCRIPTION OF THE PREFERRED EMBODIMENTS

Figure 1:
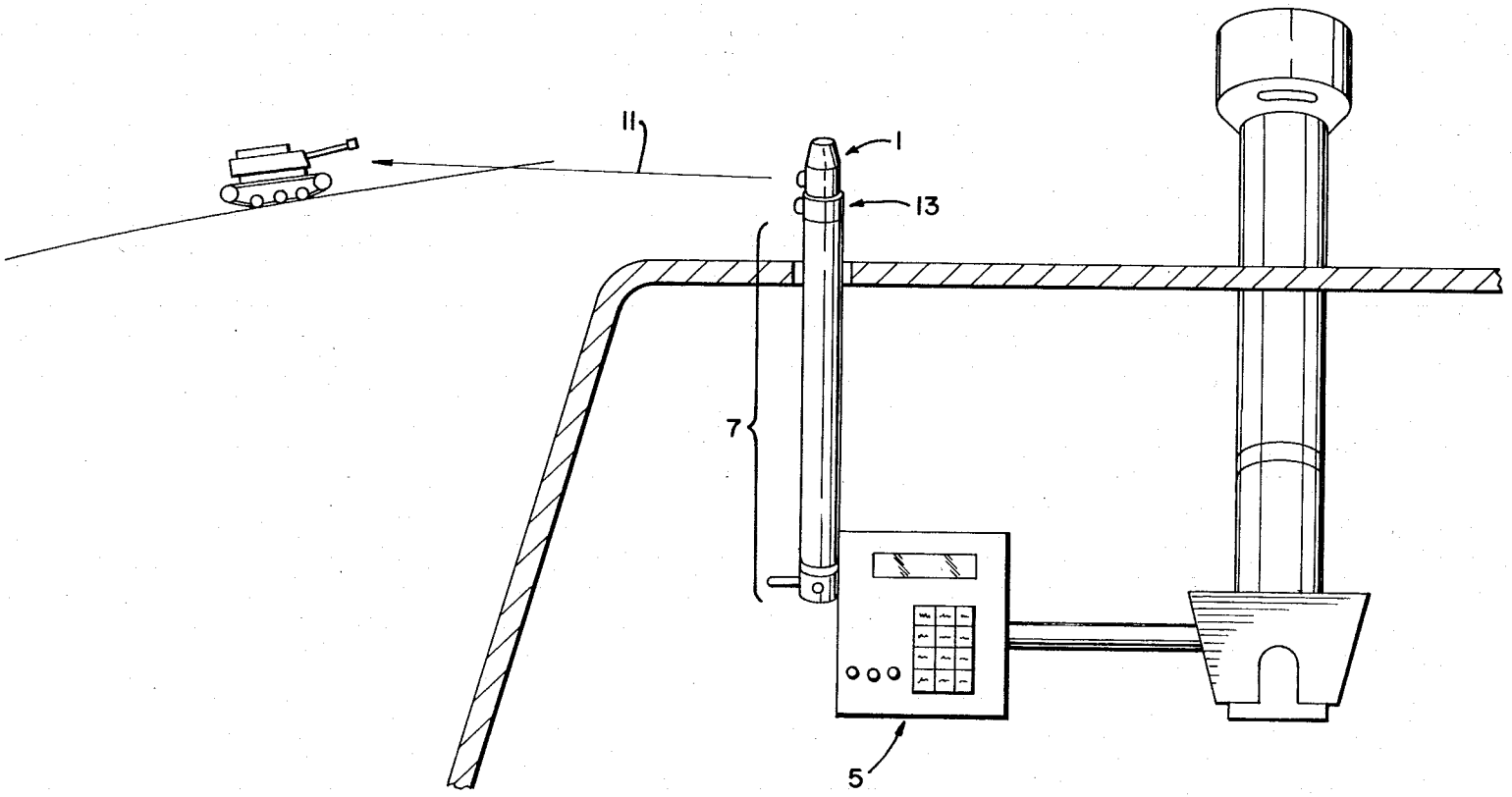
FIG. 1 shows the components of an artillery positioning system of the present invention in use on a howitzer.

FIG. 1 shows the general structure of the present invention. A first GPS ground station comprises a GPS receiving antenna 1 in combination with a howitzer referred to generally as 3. A receiving processing unit (RPU) 5 determines the three dimensional position of the howitzer from the NAVSTAR signal received by GPS antenna 1. The receiving processing unit 5 may be a conventional RPU(1) unit such as manufactured by Magnavox or Collins. The RPU decodes the satellite signals and solves a series of simultaneous equations to determine the three dimensional position of the antenna of the GPS ground station in a manner known to those skilled in the art. A gunner aligns the panoramic sight 7 along a base line 11. The base line is formed between the howitzer 3 and a second GPS station that has a known position. The gunner calibrates the main sighting device by aligning the mil scale of the panoramic sight so that the second GPS station is located at the reference azimuthal angle determined by the RPU. Alternately, the computer can orient the scale if the sight is designed to incorporate necessary encoders. The present invention quickly and accurately provides input to support a wide range of robotics, automation and datamation for the conduct of fire.

One advantage of the present invention is that the panoramic sight is modified only to the extent necessary to enable the gunner to locate and align the mil scale off the second GPS ground station. The modified mil scale can also sight off aiming stakes in accordance with conventional survey techniques. Thus, the present invention provides its own back up system in the event that the GPS positioning technique fails for any reason.

The process for aiming a piece of artillery begins with the first GPS station computing its position and receiving the position of the second GPS station. This positional information may be transmitted over conventional intrabattery communications link such as a radio or telephone, or by a modulated laser beam. The gunner or computer then determines north by subtracting the "northings" and "eastings" as supplied by the RPU. The angle of the base line with respect to north can be determined by simple trigonometry. The gunner or computer sets the mil scales on the panoramic sight to the second GPS station to correspond to the calculated angle. The gunner then performs the conventional firing calculations and aims the gun. After firing, the howitzer moves to a new, safer position, preferably before the counterbattery weapons of the enemy return fire. The aiming process is repeated at the new position.

All terrestrial targets anywhere on the surface of the earth can be referenced with respect to the common GPS coordinates as measured on the grid formed with the common base line and north. The common reference coordinates is a feature of the GPS system which references all points on the surface of the earth on a common GPS spheroid. Thus, the present invention frees the gunner from having to transform coordinate systems.

The accuracy required to position a particular type of howitzer is known in the art as, for example, tabulated in the PosNav tables published by the United States Army. Generally, the accuracy of the angle of the base line formed between the ground stations and a fixed reference direction must be known within an uncertainty of a mil as viewed on the mil scale. The accuracy of the baseline is related to the certainty in the position of the GPS ground stations. The P code of the GPS system enables the GPS ground stations to determine a more accurate position than does the CA code. Present GPS ground stations can use the P code to determine its position within an uncertainty corresponding to a spherical volume of approximately 6 meters in diameter as compared to a spherical volume of approximately 30 meters in diameter using the CA code. Thus, it is considered preferable for the present invention to use GPS receivers that can receive the P code. The long base line between the GPS stations further minimizes any error in establishing the angle of the base line caused by the uncertainty in the position of the GPS ground stations and may be established so as to obtain a desired accuracy.

The uncertainty in the location of the GPS ground station, however, does not necessarily produce a corresponding error in the angle of the base line. It is thought that the uncertainty in geographic position is approximately reciprocal for GPS ground stations in close geographic proximity. If the calculated position of neighboring GPS ground stations is in error by the same amount in the same direction, the angle of the base line connecting the stations does not change relative to an arbitrary direction such as north and the uncertainty in position of the GPS ground stations introduces no error in aiming the guns. Further, the effect of any nonreciprocal uncertainty in the position of the GPS ground stations is minimized by the relatively large base line distance separating the ground stations. It is therefore to be appreciated that the accuracy of the present invention is not limited by the uncertainty in the position of the GPS ground stations but by the magnitude of nonreciprocal error in the position determined by GPS ground stations in close geographic proximity and by the base line distance separating the ground stations. The CA code might be suitable for determining the angle of the base line with or without additional enhancements to decrease the inherent uncertainty in the position of the GPS ground stations.

The foregoing considerations also apply when using the P code and suggest how the present invention could continue to operate with signals from the GPS satellites that are degraded as by, for example, intentional interference.

Current positioning systems increase their accuracy by estimating the separation of each howitzer from the aiming circle. The distance is typically determined with the aid of an infrared or laser range finder, or by traditional survey estimation. The present invention may retain the ability to accommodate an electronic range finder to determine the distance between the GPS ground stations, or the distance between a GPS ground station and a known point, established for using the less accurate CA code together with the "differential" techniques of GPS mathematics. The laser range finder also could, if necessary, be used to insure a predetermined separation between ground stations sufficient to reduce, to within an acceptable tolerance, any error in establishing the angle of the base line connecting the ground stations. As shown in FIG. 1, a MELIOS or similarly capable distancer 13 can even be applied in the howitzer equipment itself. Most distance measuring equipment, however, is normally incorporated into battery or battalion level survey equipment.

It is to be appreciated from the foregoing discussion that the aiming procedure of the present invention is simple, quick and accurate.

The present invention does not require replacing present aiming hardware. Rather, the GPS receivers merely eliminate the time consuming initial steps in surveying the battery positions. The final aiming of the gun involves transferring the azimuthal coordinates to the artillery piece by using the panoramic sight to align the mil scale on a GPS station rather than an aiming stake. Thus, the present invention is not only fully compatible with present artillery equipment but also enables an artillery battery to continue firing by using other positioning systems if the GPS NAVSTAR system is destroyed or degraded. This fall back feature presents a significant utility because the GPS NAVSTAR system may be vulnerable to being jammed or destroyed in any conflict between the United States and NATO Forces against an aggressor with anti-satellite weapons.

The speed of positioning the artillery is increased by positioning the GPS receiver with the gunner, preferably by incorporating a GPS antenna and RPU unit directly into the trunnion of a howitzer. Integrating GPS technology directly into the fire control system of the howitzer makes the GPS information instantly available to the gunner. It is further preferred that the second GPS station comprise a second howitzer, although the second GPS station could comprise any GPS antenna such as carried by an ammunition or service vehicle or even a dismounted soldier. Placing a GPS ground station on each howitzer enables the guns to operate in units of two.

Particular utility can be obtained by placing the aiming hardware of the present invention together with the gunner inside a crew compartment that is protected from chemical, biological and radioactive (CBR) contaminates. The present invention does not require a soldier to set out aiming stakes or otherwise dismount since the entire aiming process can be performed from within the protected crew compartment. The present invention thus extends the life of a howitzer battery by eliminating any need to expose a crewman to a CBR environment each time the battery sets up at a new firing location. Means for protecting a gun crew from CBR contaminates are known to those skilled in the art.

Figure 2:
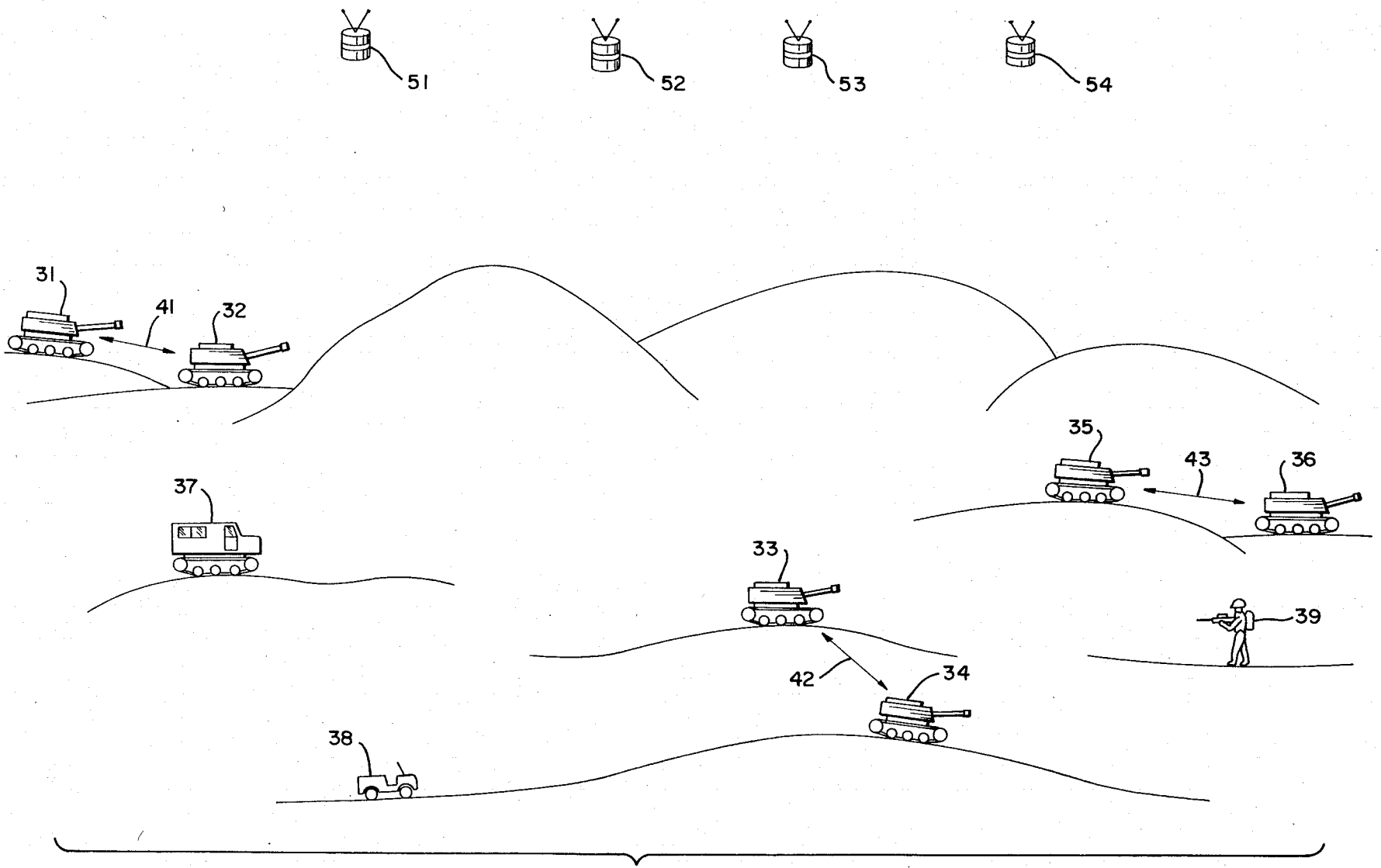
FIG. 2 is a schematic representation of an artillery battery using the present invention in combat.

FIG. 2 shows the combat tactics which are considered likely to be most effective. A battery of six howitzers 31–36, representing a typical deployment for the United States Army, are dispersed on a battlefield in groups of two, 41–43, respectively. Dispersing the howitzers in groups of two has been found to produce better combat cohesion and tactical control of the battery in other tactical settings and is therefore considered optimal for the present invention also. The NAVSTAR satellites, represented by satellites 51–54 supply ephemeral data to the GPS receivers of each howitzer. A fire direction center (FDC) 37 is positioned to direct the battery and also may contain a GPS receiver.

As shown in FIG. 2, the preferred embodiment of the present invention obtains maximum dispersion of the battery by moving the pairs of howitzers out of optical sight of another pair. Nevertheless, the RPU units of each howitzer could preferably increase the accuracy of its position determination by averaging positional information from more than one GPS ground station such as FDC 37, service vehicle 38 or ground RPU 39. A redundancy of GPS stations is also desirable in the event that a GPS receiver processor or communication link becomes disabled. Thus, the present invention contemplates an application of GPS to the deployment of artillery that accommodates existing tactical practice, improves speed and accuracy while also providing a backup aiming method that is consistent with present equipment.

The principles, preferred embodiments, and modes of operation of the present invention have been described in the foregoing specification in terms of necessary modifications to existing equipment. The invention that is intended to be protected herein should not, however, be construed as limited to the particular implementations described, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. An apparatus for aiming a ballistic trajectory launcher or other ordenance, comprising:

first and second geopositioning system (GPS) ground stations for determining first and second positions, respectively, said first and second positions being remote from each other, said first GPS ground station being integral with a first piece of artillery;

means for communicating the position of said second GPS ground station to said first GPS ground station;

a first Receiver Processor Unit (RPU) for determining an external reference direction from said first and second position determinations at said first GPS ground station;

means for computing a first azimuthal angle of said second GPS ground station relative to said external reference direction at said first GPS ground station; and first means for transferring said first azimuthal angle to the first piece of artillery, including means for aligning said second GPS ground station at said first azimuthal angle.

2. An apparatus as claimed in claim 1, further comprising:

means for determining a distance between said first and second GPS ground stations at said first GPS ground station; and means for supplying said distance to said first RPU at said first GPS ground station.

3. An apparatus as claimed in claim 2, wherein said means for determining the distance between the first and second GPS ground stations comprises a separate range finding device at said first GPS ground station.

4. An apparatus as claimed in claim 2, wherein said means for determining the distance between the first and second GPS ground stations comprises means for accommodating differential techniques in performing the GPS computations.

5. An apparatus as claimed in claim 2, further comprising means for determining the distance between the first GPS ground station and additional GPS ground stations at said first GPS ground station

6. An apparatus as claimed in claim 1, further comprising:

means for making said first transfer means directly available to a gunner; and means for protecting said gunner from chemical, biological and radioactive (CBR) contaminates at said first piece of artillery.

7. An apparatus as claimed in claim 1, wherein said first transfer means includes back up means for transferring an azimuthal angle from an object having a position known by survey techniques.

8. An apparatus as claimed in claim 1, wherein said first piece of artillery comprises a howitzer.

9. An apparatus as claimed in claim 8, wherein:

said howitzer includes a trunnion; and said GPS ground station and RPU are incorporated into said trunnion so as to be directly accessed by a crewman of said howitzer.

10. An apparatus as claimed in claim 1, wherein said first piece of artillery comprises an air defense artillery system such as a missile battery or a Remotely Piloted Vehicle battery.

11. An apparatus as claimed in claim 1, wherein said first and second ground stations receive the P code from the geopositioning system.

12. An apparatus as claimed in claim 1, wherein said first and second ground stations receive the CA code from the geopositioning system.

13. An apparatus as claimed in claim 1, further comprising:

means for communicating the position of said first GPS ground station to said second GPS ground station, said second GPS ground station being integral with a second piece of artillery;

a second Receiver Processor Unit (RPU) for determining an external reference direction from said first and second position determinations at said second GPS ground station;

means for computing a second azimuthal angle of said first GPS ground station relative to said external reference direction at said second GPS ground station; and second means for transferring said second azimuthal angle to the second piece of artillery, including means for aligning said first GPS ground station at said second azimuthal angle.

14. An apparatus as claimed in claim 13, further comprising:

means for determining a distance between said first and second GPS ground stations at said second GPS ground station; and means for supplying said distance to said second RPU at said second GPS ground station.

15. An apparatus as claimed in claim 14, wherein said means for determining the distance between said first and second GPS ground stations comprises a separate range finding device at said second ground station.

16. An apparatus as claimed in claim 14, wherein said means for determining the distance between said first and second GPS ground stations comprises means for accommodating differential techniques in performing the GPS computations at said second GPS ground station.

17. An apparatus as claimed in claim 13, further comprising means for determining the distance between said second GPS ground station and additional GPS ground stations.

18. An apparatus as claimed in claim 13, further comprising:

means for making said second transfer means directly available to a gunner; and means for protecting said gunner from chemical, biological and radioactive (CBR) contaminates at said second piece of artillery.

19. An apparatus as claimed in claim 13, wherein said second transfer means includes back up means for transferring an azimuthal angle from an object having a position known by survey techniques.

20. An apparatus as claimed in claim 13, wherein said second piece of artillery comprises a howitzer.

21. An apparatus as claimed in claim 13, wherein said second piece of artillery comprises an air defense artillery system such as a missile battery or a Remotely Piloted Vehicle battery.

22. A method of aiming a ballistic trajectory launcher or other ordenance, comprising the steps of:

determining first and second positions of first and second geopositioning system (GPS) ground stations, respectively, said first and second positions being remote from each other, said first GPS ground station including a first piece of artillery;

communicating the position of said second GPS ground station at said first GPS ground station;

determining the external reference direction from said first and second position determinations at said first GPS ground station with a first Receiver Processor Unit (RPU);

computing a first azimuthal angle of said second GPS ground station relative to said external reference direction at said first GPS ground station; and transferring said first azimuthal angle to the first piece of artillery by aligning said second GPS ground station at said first azimuthal angle.

23. A method as claimed in claim 22, further comprising the steps of:

determining a distance between said first and second GPS ground stations at said first GPS ground station; and supplying said distance to said first RPU at said first GPS ground station.

24. A method as claimed in claim 22, further comprising the steps of:

making said first azimuthal angle directly available to a gunner; and protecting said gunner from chemical, biological and radioactive (CBR) contaminates at said first piece of artillery.

25. A method as claimed in claim 22, wherein said step of determining said first and second positions includes the steps of receiving and decoding the P code from said geopositioning system

26. A method as claimed in claim 22, wherein said step of determining said first and second positions includes the steps of receiving and decoding the CA code from said geopositioning system.

27. A method as claimed in claim 22, further comprising the steps of:

communicating the position of said first GPS ground station to said second GPS ground station, said second GPS ground station being integral with a second piece of artillery;

determining an external reference direction from said first and second position determinations at said second GPS ground station with a second Receiver Processor Unit (RPU);

computing a second azimuthal angle of said first GPS ground station relative to said external reference direction at said second GPS ground station; and transferring said second azimuthal angle to the second piece of artillery by aligning said first GPS ground station at said second azimuthal angle.

28. A method as claimed in claim 27, further comprising the steps of:

determining a distance between said first and second GPS ground stations at said second GPS station; and supplying said distance to said second RPU at said second GPS ground station.

29. A method as claimed in claim 27, further comprising the steps of:

making said second azimuthal angle directly available to a gunner; and protecting said gunner from chemical, biological and radioactive (CBR) contaminates at said second piece of artillery.

* * * * *